US007478680B2

(12) United States Patent
Sridharan et al.

(10) Patent No.: US 7,478,680 B2
(45) Date of Patent: Jan. 20, 2009

(54) FIRE EXTINGUISHING BY EXPLOSIVE PULVERISATION OF PROJECTILE BASED FROZEN GASES AND COMPACTED SOLID EXTINGUISHING AGENTS

(76) Inventors: Vinayagamurthy Sridharan, 63 Dr. Alagappa Rd., Purasaiwalkam (IN) 600084; Ram Vairavan, 1647 Andorre Glen, Escondido, CA (US) 92025

( * ) Notice: Subject to any disclaimer, the term of this patent is extended or adjusted under 35 U.S.C. 154(b) by 878 days.

(21) Appl. No.: 10/905,860

(22) Filed: Jan. 24, 2005

(65) Prior Publication Data

US 2006/0162941 A1 Jul. 27, 2006

(51) Int. Cl.
*A62C 8/00* (2006.01)

(52) U.S. Cl. ..... 169/36; 169/30; 169/54; 169/71; 102/368; 102/369; 102/370

(58) Field of Classification Search ..... 169/28, 169/36, 46, 47, 52–54, 56, 62, 68, 71; 102/367–370, 102/393, 475, 489, 490; 239/171
See application file for complete search history.

(56) References Cited

U.S. PATENT DOCUMENTS 1,317,551 A * 9/1919 Chambers ..... 102/365
1,903,348 A * 4/1933 Anderson ..... 102/369
2,633,920 A * 4/1953 Carlson ..... 169/33
2,665,768 A * 1/1954 Talbot ..... 169/36
2,703,527 A * 3/1955 Hansen ..... 102/365
3,065,798 A * 11/1962 Pearson et al. ..... 169/36
3,382,800 A * 5/1968 Biggs, Jr. ..... 102/369
4,353,303 A * 10/1982 Bell ..... 102/367
4,798,143 A * 1/1989 Graham ..... 102/370
6,470,805 B1 * 10/2002 Woodall et al. ..... 102/370
7,121,353 B2 * 10/2006 Setzer ..... 169/28

* cited by examiner

*Primary Examiner*—Len Tran
*Assistant Examiner*—Jason J Boeckmann
(74) *Attorney, Agent, or Firm*—Richard Rouse

(57) ABSTRACT

This invention relates to a forest, terrain and urban fire fighting device and method, and more particularly, to a fire extinguishing system and method offering reduced risk of fire spread and safety of firemen. This extinguishing device consists of an encapsulated cryogenic projectile with a payload of solidified and frozen mixture of carbon dioxide, nitrogen, combination of gases and compacted solid extinguishing agents. These strategically located and cryogenically stored devices are launched at the outbreak of fire, aerially or terrestrially over a blaze. An embedded explosive charge is detonated at a predetermined and optimum height causing the solidified gases/compacted solid extinguishing agents to be dispersed instantaneously and forcefully over targeted and specified areas. The release of high pressure, low temperature oxygen exclusion gases penetrate the fire from above, chills the substrate and extinguishes the fire. As carbon dioxide is heavier than air it hangs as a cloud over the extinguished substratum effectively preventing reignition. Fly ash, fine quarry dust or any solid or semisolid extinguishing agent can also be made to disperse under force over the fires in the same mode which cuts off the oxygen supply to the burning substrates. By effectively checking and cooling the fuel complex substrate by successive pulverizations as needed this invention enables a low cost, scalable, and effective urban, terrain and forest fire intervention/extinguishing process.

20 Claims, 10 Drawing Sheets

*TERRESTRIALY LAUNCHED PROJECTILE IN ITS VARIOUS STAGES OF ITS TRAJECTORY*

*LATERAL VIEW OF THE PROJECTILE*

*FRONT VIEW OF THE PROJECTILE*

*REAR VIEW*

*CROSS SECTION OF THE PROJECTILE*

*AXIAL CROSS SECTION OF TERRESTRIAL LAUNCH PROJECTILE*

*AXIAL CROSS SECTION OF AERIAL LAUNCH PROJECTILE*

*CROSS SECTION OF THE PROJECTILE DURING PULVERISATION*

*TERRESTRIALY LAUNCHED PROJECTILE IN ITS VARIOUS STAGES OF ITS TRAJECTORY*

*AERIALLY LAUNCHED PROJECTILE IN ITS VARIOUS STAGES OF TRAJECTORY*

BLOCK DIAGRAM FOR AUTOMATED TERRAIN LAUNCHING MODE

*BLOCK DIAGRAM FOR AUTOMATED AIR LAUNCHING MODE*

Figure 1:
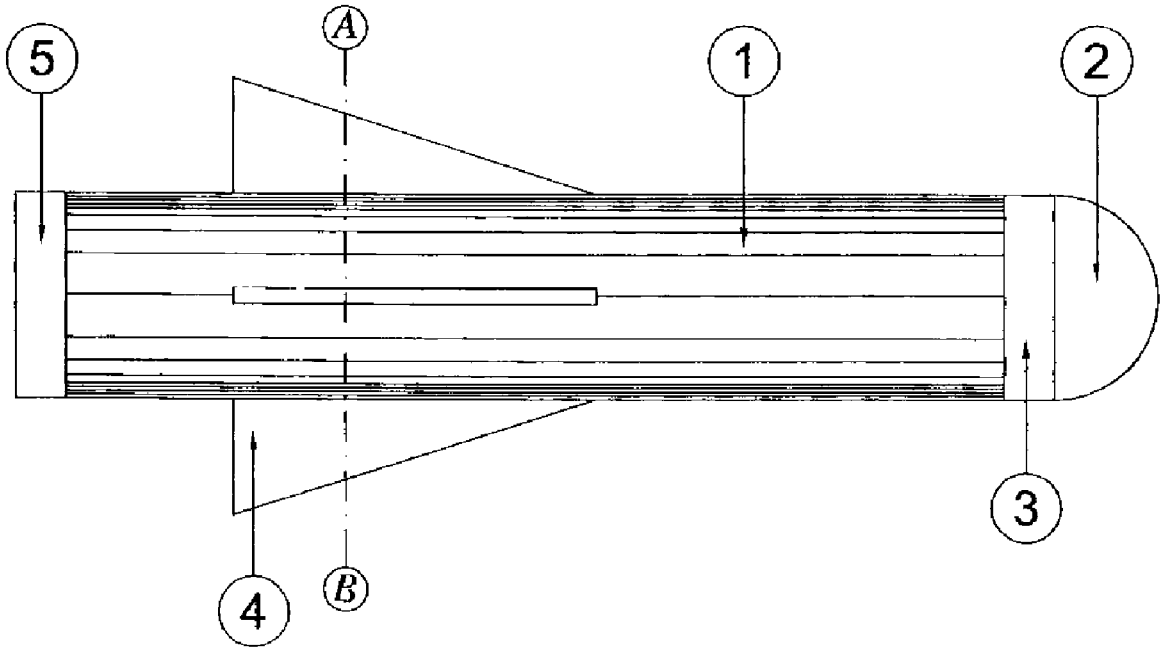

FIRE EXTINGUISHING BY EXPLOSIVE PULVERISATION OF PROJECTILE BASED FROZEN GASES AND COMPACTED SOLID EXTINGUISHING AGENTS

FIELD OF INVENTION

The present invention relates to fire fighting equipment and methods, more particularly to an aerially and terrestrially deployable extinguishing device. An encapsulated projectile containing compacted, solidified and frozen non-reactive gases with an embedded explosive charge is launched onto the fires, and detonated causing a pressurized burst and a propagation wave of gases at a height above the fires. This deprives the fire of the essential oxygen while simultaneously lowering and cooling the temperature of the burning substrate.

Alternative launching and pulverization of a combination of extinguishing agents such as compacted fly ash, quarry dust as pay loads in the projectile, on forceful dispersion over the fires, cuts off the oxygen access and extinguish the fires.

Essentially, the following are the matters that will be considered in relation to this invention. They are firstly the operational or functional features of the device, and then there are the technical features, namely how the invention is implemented, how the invention is provided to the users, and finally, how the invention is handled by the providers of services and the fire departments and/or their support agencies/service providers.

BACKGROUND OF INVENTION WITH REGARD TO THE DRAWBACKS ASSOCIATED WITH KNOWN ART

The second law of thermodynamics establishes that everything moves towards equilibrium because of entrophy. When applied, this second law of thermodynamics translates to the effect that a heated/burning substratum has gained a higher temperature than that of the ambient temperature by an uncommon factor and would always tend to gain equilibrium with the atmospheric/ambient temperature by giving up the extra heat readily.

A critical temperature in the range of 3800 degree centigrade is required to ignite a substrate in the presence of Oxygen and the burning process becomes a self-sustaining cycle. Hence effective firefighting must address control of most of these crucial variables by removing them.

It is known in the art that water delivered on the fire, fulfilling the objective of cooling the substrate and extinguishing the fire by cutting off the oxygen supply. It is also known that chemicals are used instead of water when the fires are due to flammable liquids where use of water would prove to be counterproductive.

Water dousing of fires is based on the ability of the water to reduce surface tension and also to form small drops that absorb heat. It is also known in prior art that foam blanketing is deployed where the fires originate from chemicals such as oil, tar, high-octane aviation fuel fires. Foam retards and extinguishes fire by cutting off oxygen by its enveloping and expanding properties.

The water delivery mechanisms vary from simple gravitational flow to engine assisted pressurized delivery through hosepipes and varied nozzles. A wide array of auxiliary equipment like breathing apparatus, extrication tools play a supportive role. Pneumatic and hydraulic elevatable platforms in an assorted variety act as a force multiplier equipment for the above mode of art. Prior art basically rests on the sequence of fire detection, mobilization of men and equipment to the site, protection of exposed and vulnerable buildings and materials intervention to confine, extinguishing the fire, rescue and salvage operations. This sequence is organized as per standard procedures under a hierarchy of command structure determining the order of priorities.

The limiting factor of prior art is multi-faceted. When fires occur in far-off places rapid response is curtailed by the logistical problems of moving heavy equipment in a rapid way. At the site of the fire the ability to get sufficiently closer to a fire for effective intervention is impeded by unbearably scorching heat, suction and depletion of oxygen impairing the efficiency of firemen and equipment. Wild fires assisted by high wind spread so fast, the controlling it requires firemen by the thousands.

The wild fires are tackled with trenches as firebreaks, aerial bombing with water, dropping fire retardant chemicals from flying craft known as smoke jumping and planned back burning. However it is known and recorded that some wild fires have crossed four lane roads to continue their incineration spree.

The prior art of aerial delivery of fire retardants are plagued by inadequate, inconsistent and uneven dispersion of extinguishing materials, consequences of which is the reignition of doused areas. The extent of surface area of a burning substrate the aerially delivered method covers is so inadequate when compared to the total conflagration; the entire exercise becomes unworkable and unfeasible to be an effective tool and method.

It emerges from the prior art that the scope, methods and fire fighting equipments are far too limited in their ability to 1) rapidly respond, 2) precisely deliver fire retardants, 3) effectively confine the fire and 4) eventually extinguish effectively. The level of risk and danger the firemen are exposed in the processes of prior art leaves much to be desired.

OBJECT OF INVENTION

The object of the invention is to find a means of overcoming the multitude of shortcomings and handicaps the prior art is beseeched with. The rate of successful fire intervention, containment and effective extinguishing is very far from satisfactory. The systems now in use at best play a damage-minimizing role during fire occurrences. It is not uncommon to allow fires to continue and burn out totally by consuming the entire fuel complexes due to the inadequacies of the methods now in vogue. The principal object of the present invention is to enhance the state of the art of fighting forest, urban and other types of fires.

This cryogenic projectile-based system of fire extinguishing is a system by which the objective of an effective fire fighting is fulfilled to a very large extent. The object of the invention is to put a system in place to rapidly intervene, effectively contain, and successfully extinguish all types of fires in all weather and all terrain conditions.

SUMMARY OF INVENTION

The multiple disadvantages and inadequacies of the prior art are overcome by the present invention whose principal object is to enhance the state of the art for fighting forest, terrain, and urban and other types of fires. This invention in particular facilitates effective tackling, intervention and extinguishing of fires, which are difficult to approach and fight in near proximity.

The operational/functional features of the device and method of the present invention contemplates remote delivery of cryogenic projectiles containing solidified inert gases and compacted solid extinguishing agents by means of flying crafts as well as by terrain based launchers such as modified artillery guns and multibarrel rocket launchers. The inert gas mixtures that constitute the frozen matrix of the projectile consist of carbon dioxide and nitrogen gas combinations.

The term mixture is used herein in its broadest sense to include all types extinguishing agents in frozen, solid, compacted fine powders and other states. A cylindrically shaped projectile, with a payload of frozen mixed inert gases is made to pulverize and sublimate as a pressurised wave by exploding an embedded charge over fires. The projectile is encapsulated in an easily disintegrating material. The strategically positioned and embedded explosive charge, under a metal cladding, which is designed to direct the wave of dispersion precisely towards the targeted fire zones, is made to explode at a predetermined optimum height above the fire.

Upon detonation the frozen inert gases expand as a forceful burst, which engulf and penetrate the fire. This process excludes the oxygen and lowers the temperature of the substrate that sustains the burning process. The extinguishing agent is atomized into micro fine particles by the explosion. During detonation of the explosive charge embedded in the extinguishing agent, a pressure of several thousand bar is developed and the atomized agent is thrown by the resultant pressure wave from the center of the explosive charge into the burning substratum.

By an explosive charge here it is meant as one, which develops a detonation wave with a propagation speed of 5000 meters per second and above. In the process of atomization of the extinguishing agent, owing to the small size of the individual particles, and due to the increase in the surface area, a substantial cooling effect takes place resulting in a blow out effect.

As carbon dioxide is heavier than air and can concentrate in low areas or in enclosed spaces it prevents reignition of substrates and fuel complexes besides excluding oxygen.

Compacted fly ash, quarry dust or any other extinguishing agent loaded in place of the frozen matrix and made to pulverize on detonation, also effectively cuts off the oxygen that sustains the fire and also absorbs the heat of the burning substrate.

A BRIEF DESCRIPTION OF THE ACCOMPANYING DRAWINGS

Figure 2:
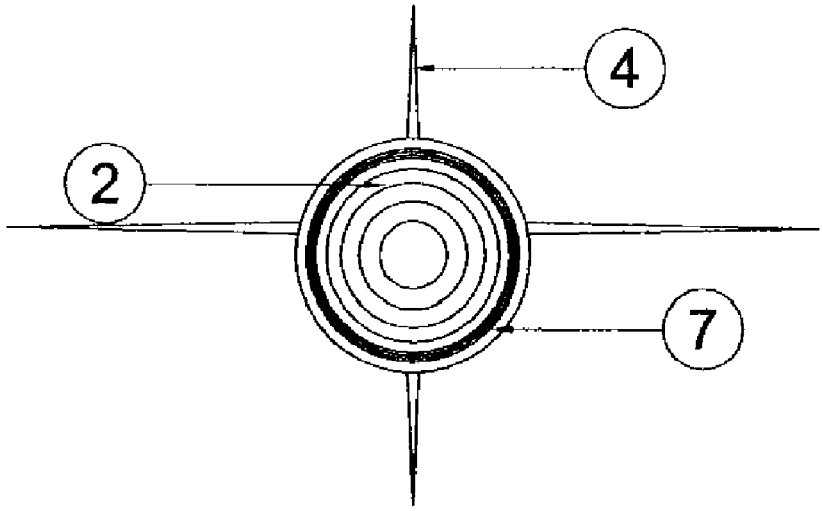
Figure 2:
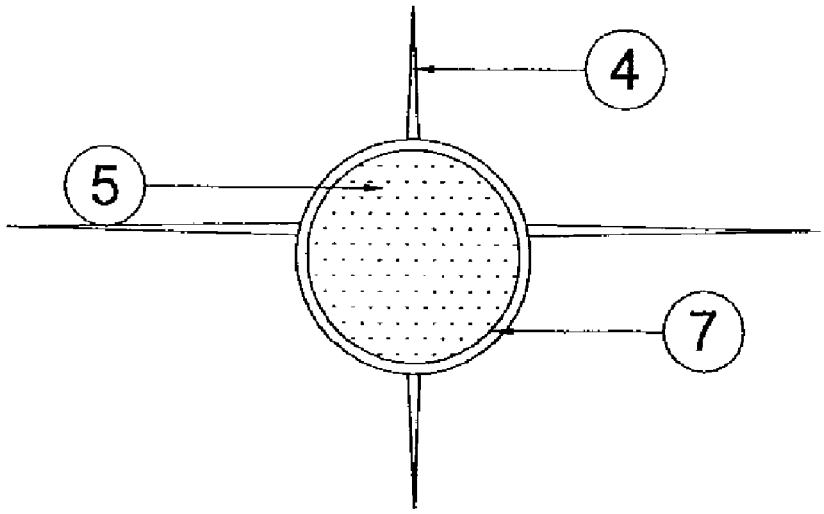
Figure 3:
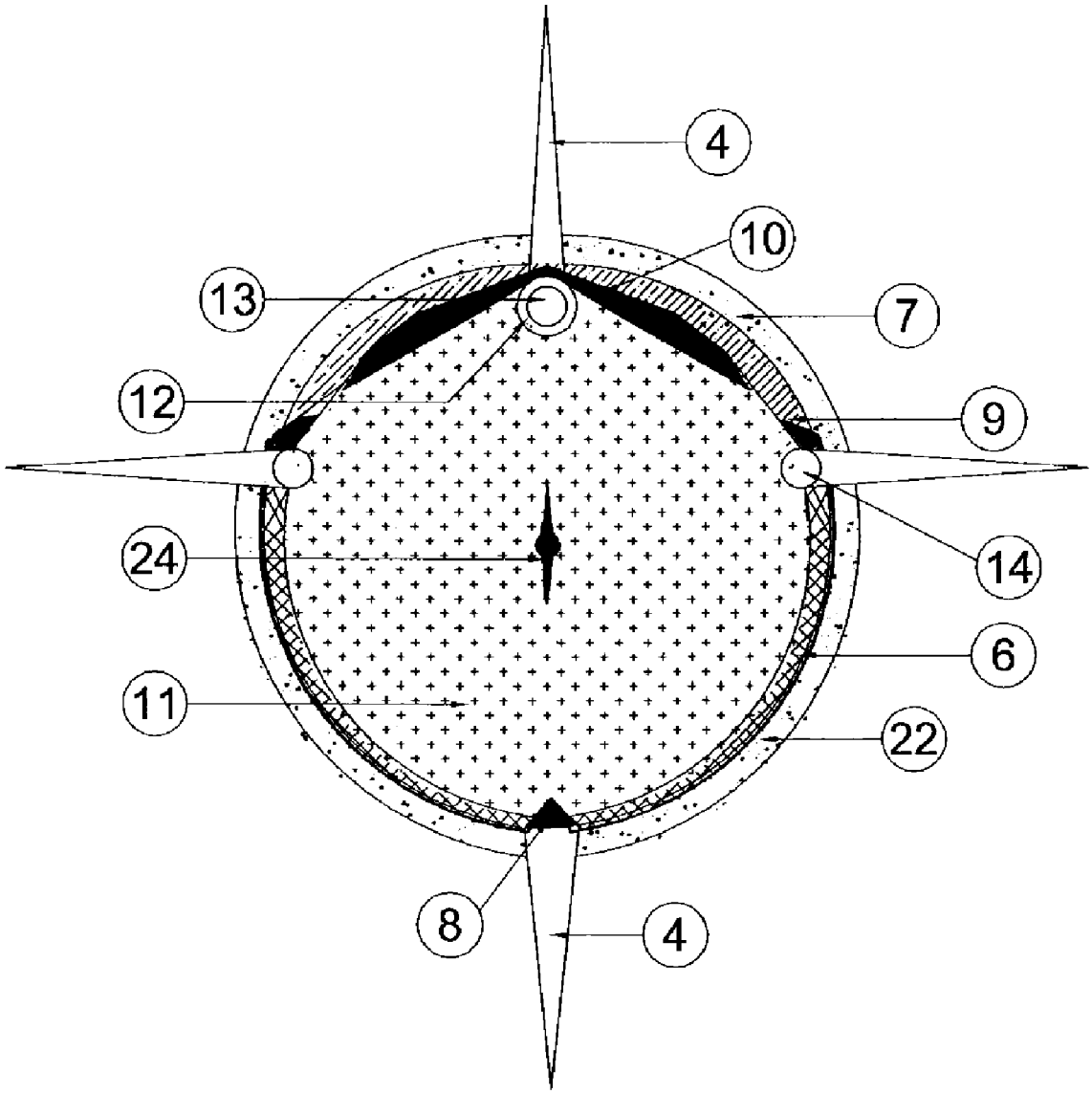

A better understanding of the invention will be obtained by reference to the detailed description below, in conjunction with the following drawings, in which:

FIG. 1 is a perspective view of the present invention, depicting in a schematic way the lateral view of the projectile, according to the preferred embodiment of the present invention, FIG. 2 is a perspective view of the present invention, depicting in a schematic way the anterior and posterior view of the projectile, according to the preferred embodiment of the present invention, FIG. 3 is a cross-section at point A-B of FIG. 1 of the projectile, according to the preferred embodiment of the present invention.

Figure 4:
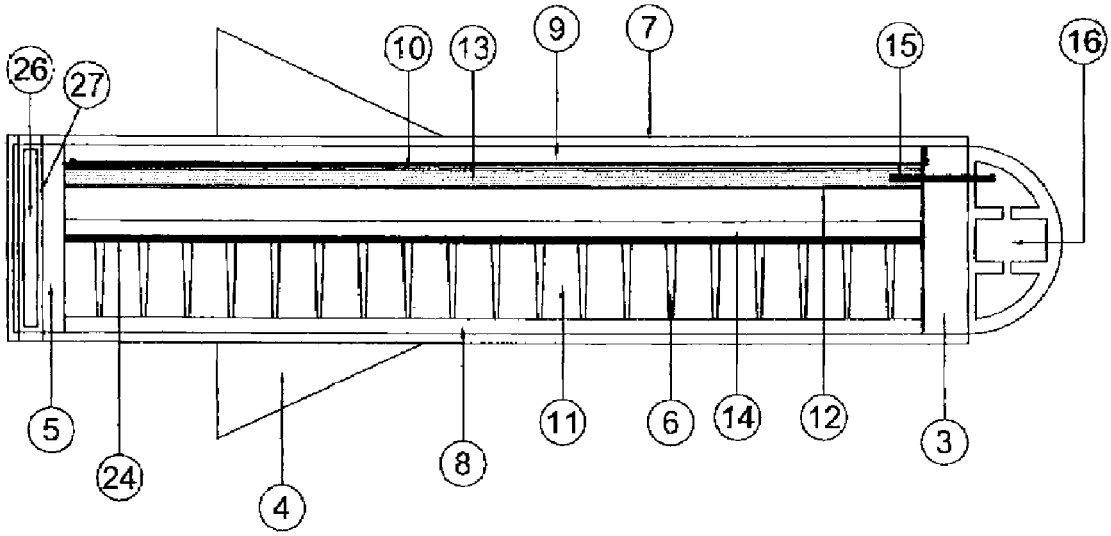
Figure 5:
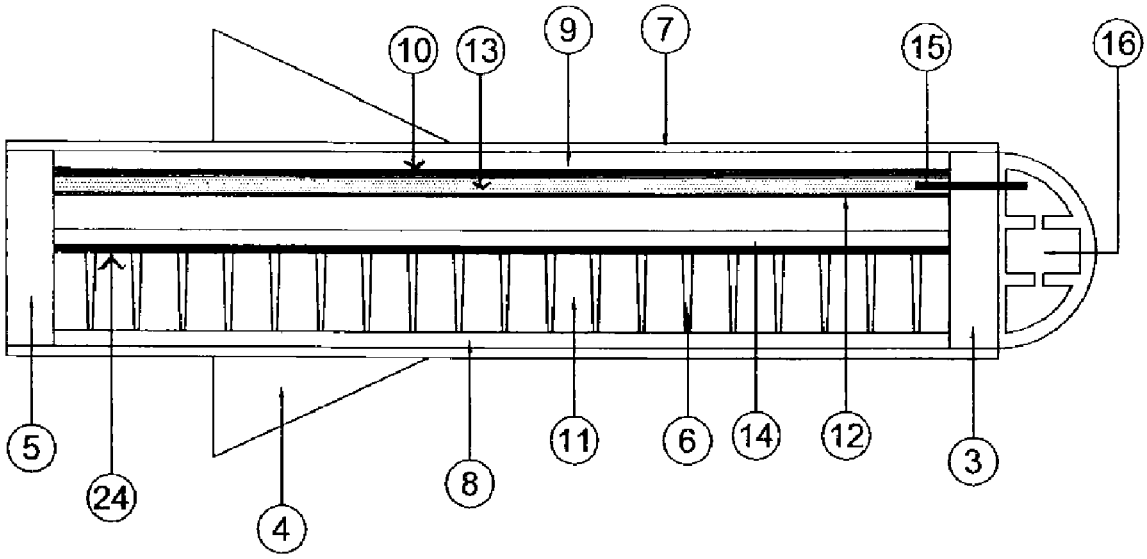
Figure 6:
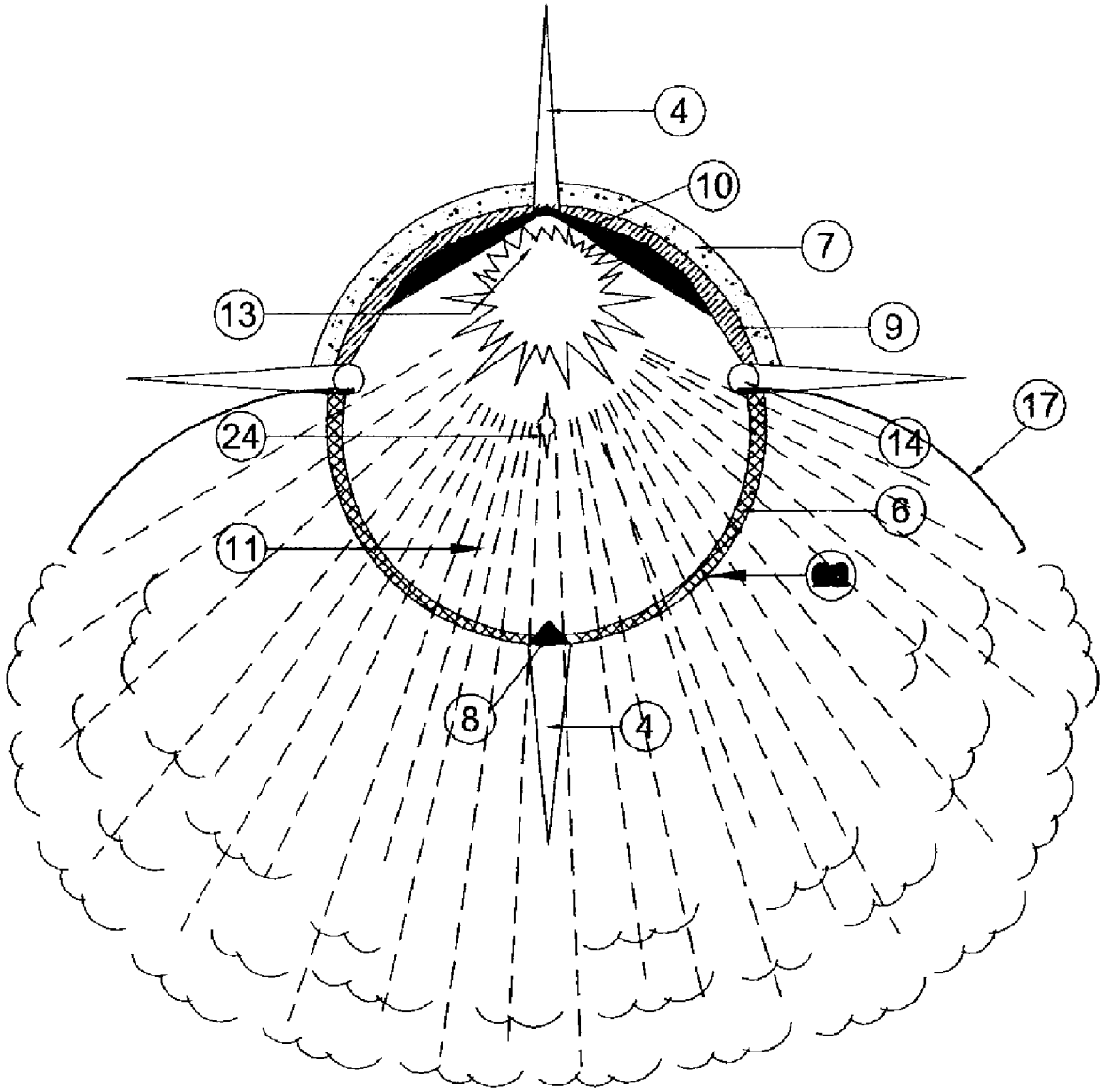
Figure 7:
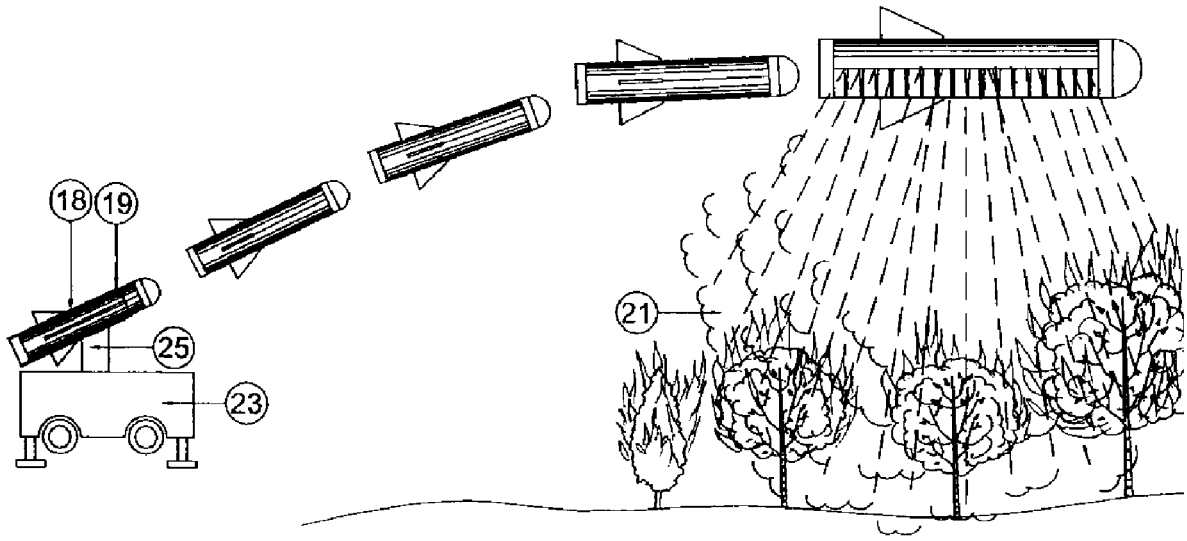
Figure 8:
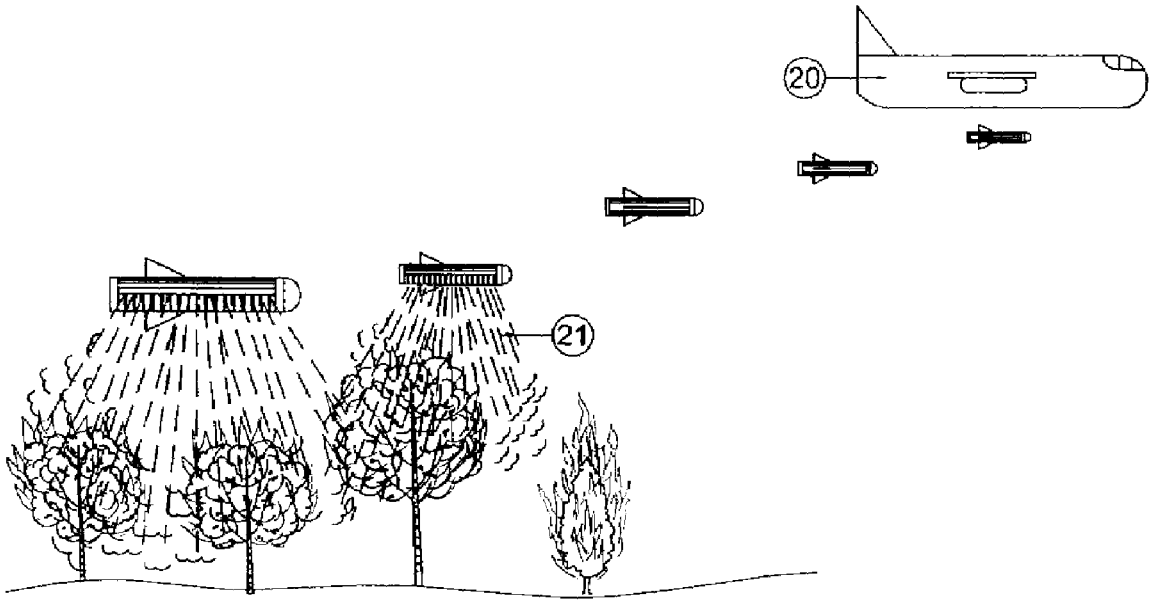

FIG. 4 is an enlargement of longitudinal cross-section of the terrestrially lauchable projectile, depicting the inner arrangement of the projectile, according to the preferred embodiment of the present invention, FIG. 5 is an enlargement of longitudinal cross-section of the aerially lauchable projectile, depicting the inner arrangement of the projectile, according to the preferred embodiment of the present invention, FIG. 6 is a perspective view illustrating the cross section of the projectile at the moment of detonation of the explosive charge, dispersing the payload with the ventral plates in open position, according to the preferred embodiment of the present invention FIG. 7 is a perspective view illustrating a terrestrially launched projectile in its various phases of descent and depicts extinguishing of fires by a detonation wave, propagating the pulverized frozen payload of inert gases, according to the preferred embodiment of the present invention, FIG. 8 is a perspective view illustrating an aerially launched projectile from a flying craft, in its various phases of descent and depicts the detonation wave of pulverizing frozen payload of inert gases being directed and applied to a forest fire, according to the preferred embodiment of the present invention.

Figure 9:
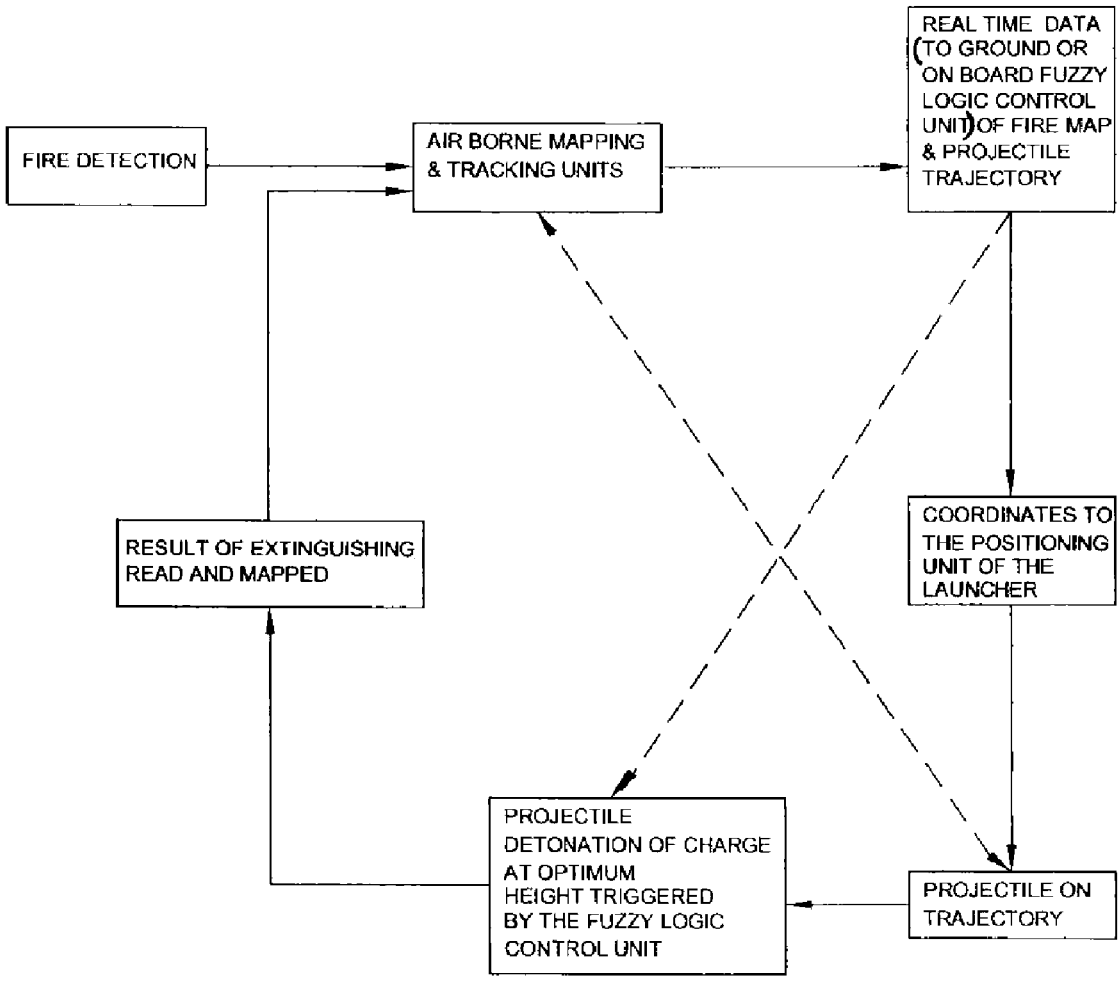
Figure 10:
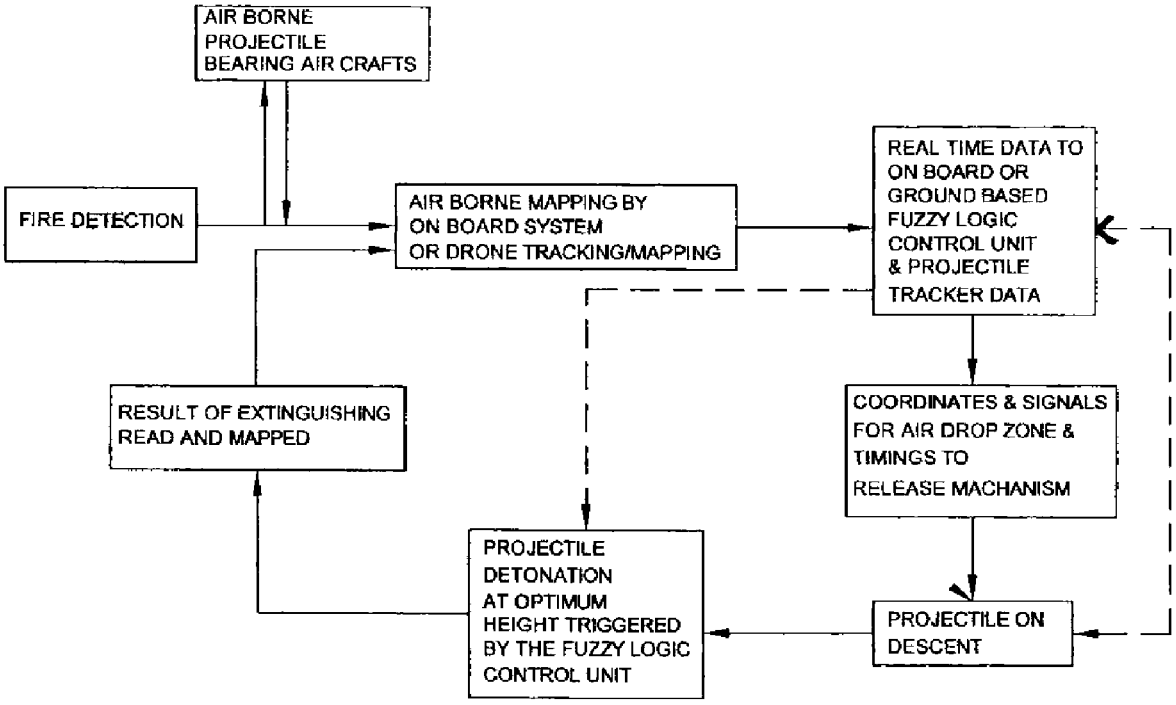

FIG. 9 is a block diagram sequencing the method of fire detection, mobilization, launch and control during terrestrial deployment mode, according to the preferred embodiment of the present invention, FIG. 10 is a block diagram sequencing the method of fire detection, mobilization, launch and control during aerial deployment mode, according to the preferred embodiment of the present invention.

DETAILED DESCRIPTION OF THE INVENTION WITH REFERENCE TO DRAWINGS AND PREFERRED EMBODIMENT

A preferred embodiment of the present invention, as well as objects, aspects, features and advantages, will be apparent and better understood from the following description in greater detail, of the illustrative and preferred embodiments thereof, which is to be read with reference to the accompanying drawings. The accompanying drawings form a part of the specification, in which like numerals are employed to designate like parts of the same.

Structure

The Device

This invention calls for a device (FIG. 1 and FIG. 3) consisting of a projectile made of metallic housing 1, filled with a mixture of frozen inert gases and/or other extinguishing agents 11, embedded with an explosive charge 13 and a method by which this projectile is launched over fires and the embedded explosive is made to explode at a predetermined height the result of which is total and permanent annihilation of fires.

With reference to the figures and drawings of the present invention, which denotes the device and method, in a general way includes a horizontal, cylindrically shaped (FIG. 1 and FIG. 3) projectile housing 1. The housing and its support components may be constructed of steel. The housing includes a curved steel outer cladding 9 on the top with ribs 6 extending from the edges of the cladding attached to the metal cladding rib interlink bar 14 at regular intervals from both sides along the axis of the housing, as a support to the frozen matrix 11 and other compacted pulverisable extinguishing agents 11 and also to lend strength to the structural integrity to the projectile. In between the outer metal cladding 9, and the charge 13 is fixed a high tensile steel angle 10 that also runs along the length of the charge 13 diagrammed in FIG. 4.

Referring to FIG. 4, in close proximity under the center of the curvature of the metal cladding 9 and below the steel angle 10, a hollow in the frozen matrix holds an explosive charge 13 in the shape of a cylinder running along the axis of the projectile. The shape, size, type, property, brisance and positioning of the charge is determined and modified according to the needs and anticipated modes of deployment. A detonator 15 for the charge is positioned inside FIG. 4 the charge at one end and the other end of the detonator is connected to the trigger unit 16 housed in the anterior cover 2 assembly illustrated in FIG. 1.

In FIG. 1 at the fore end of the projectile is a hemispherical dome 2 which is fitted to the front flange 3 in a detachable way which holds the response systems 16 consisting of altitude sensor, infrared sensor, the detonation activating receiver circuits and its trigger relays. FIG. 4. The master control unit is governed by fuzzy logic circuit controls, with embedded programmable integrated chips. This unit is preprogrammed to be in continuous contact with the ground control systems till the moment of detonation. At the rear end FIG. 2 and FIG. 4. is a metallic buffer 5 to cushion the projectile from the muzzle velocity during the launch. In FIG. 4, behind the buffer 5 is a detachable cartridge case 26 that holds the propellant charge 27 and primer. The primer is part and parcel of the charge. Air dropped/launched projectiles are not fitted with this cartridge case 26 with the propellant charge 27, as they descend due to the gravitational force and glide to the target propelled by the release momentum of the air borne systems. A mid axial support bar 24 runs along the length of the projectile at the center to lend additional integrity to the structure.

In FIG. 1, FIG. 3 and FIG. 4, at the base of the projectile housing 1 a metallic keel and basal support 8 connected to the rear buffer and the front flange is present to which the ribs 6 are attached. All along the edge of the metal cladding a interlink rod 14 runs to the entire length FIG. 4 of the projectile housing. The support ribs 6 are attached at one end to this interlink rod 13 and the other end of the ribs 6 are attached to the keel 8.

A pair of ventral curved doors 22 are attached at one end to the metal cladding rib interlink 14, and to the basal support bar 8 the other end. These doors lend support in holding the agents in place and swing open 17 on its hinges, on detonation of the pulverizing charge, to accommodate dispersal of extinguishing agents shown in FIG. 7.

In FIG. 3, a dorsal fin, a ventral fin and a pair of lateral fins 4 to stabilize the projectile in trajectory are attached to the metal cladding 9 and interlink rods 14 respectively. These fins are made as detachable ones, which can be latched on to the projectile, prior to deployment, to enable compact storage.

The dimension of the projectiles and its payload quantum is determined according to the requirements foreseen. Projectiles of compatible multiple dimensions are prepared, stored and deployed as per the type of launcher, type of fire encountered such as crown fires, spot fires, fires in high-rise buildings or in heavily built-up areas. According to foreseen needs the projectiles are cylindrically shaped to facilitate compatibility with the legacy firing and launching systems and towards minimum modifications.

Function of the Structures

This invention calls for a system that utilizes frozen inert gases 11 (FIG. 3), and an admixture of fire extinguishing compounds and agents to lower the freezing point of the mixture. This is done to achieve, as much absorption of heat as possible from the burning substrate on pulverization and sublimation. This process also accords more structural integrity to the frozen extinguishing matrix, which is needed to withstand the stress during transportation, muzzle velocity of launching and on the trajectory. The term frozen matrix is intended to denote an admixture of inert gases, and also to include chemicals and other agents, that extinguish fires in the broadest sense of the term.

The extinguishing agent is atomized into micro fine particles by the detonation of the embedded explosive charge FIG. 7. During detonation of a explosive charge within the extinguishing agent, a pressure of several thousand bar is developed, and the atomized agent is thrown by the resultant pressure wave from the center of the explosive charge into the burning substratum.

By an explosive charge 13 (FIG. 3), here it is meant as one, which develops a detonation wave with a propagation speed of 5000 meters per second and above. In the process of atomization of the extinguishing agent, owing to the small size of the individual particles, and due to the increase in the surface area, a flash cooling effect takes place. Simultaneously another effect of the exploding wave of the frozen extinguishing agent is the blow out effect.

Since the pulverized and sublimated inert gases used are heavier than air, a cloud of inert gases hang over the substratum, preventing it from igniting again. This process also cools the substratum below the flash point temperature required for reignition, by repeated bursts. In FIG. 3 and FIG. 6, the metal claddings 9 and the inner high tensile steel angle 10 play a crucial role in directing the pulverized frozen matrix upon explosion on to the fire at the desired angle and proximity. The role of the outer metal cladding 9 and the inner high tensile steel angle 10, in directing the atomized particles of the extinguishing agent is highly critical to achieve the desired result of the blow out and cooling effect on the target areas. Therefore the metal cladding 9 and 10 steel angle play a crucial role in determining a directed extinguishing effect due to the detonation. Adequate and repeated bursts totally extinguish the fires.

A crucial aspect that is ensured in this method is that of the detonation height. The outer metal cladding 9 and inner steel angle 10 directed propagation wave is to be started at a height that would ensure enveloping of the fire and in a blow out effect. The method of achieving the detonation at optimum height is done generally by resorting to any of these methods depending on the contingency, ground situation, availability of resources, time constraint, mobilization support and other logistics.

(1) Manual remote triggered detonation.

(2) By preprogramming the projectile's onboard infrared and other sensors in coordination with the on board altimeter. The charge is detonated on descending to a predetermined height over the fires by the preset altimeter.

(3) By incorporating a fuzzy logic based control system that independently takes the relevant variables into account such as the area of fire, heat generated, the brisance which is the expanding potential of the embedded charge, propagation speed of the explosive wave, type of extinguishing agent, weather parameters, type of substrate etc to signal detonation at optimum heights. An input such as real time data from unmanned drones deployed by armed forces for ground support roles or by means of flying crafts is channeled to the fuzzy logic controller, the sequencing and repetitive bursting modes is optimized.

(4) A single ground based fuzzy logic firing and detonation control unit can ensure optimum detonation of successively launched projectiles processing all the inputs and variables.

Default settings are embedded on the onboard control unit for the detonation trigger to set off the detonation at a specific height, a height just over the flames if the detonation command is not received after descending to a specific height over the flames. This is done to prevent the detonation of the charge in the center of the fire or on the ground level.

Preparation

In FIG. 3, the projectile is prepared by placing the metallic structure inside a hollow container consisting of two hemispherical halves clamped together. A hollow tube 12 made of easily disintegrating material is placed under the metal cladding 9 and steel angle 10 to accommodate the explosive charge 13 to be placed prior to deployment or during the preparation stage itself. The gas matrix 11 is then made to freeze inside the container to its lowest possible temperature. The projectile with its frozen payload 11 is then taken out of the container and enclosed in a well fitting cylindrical insulation sheath 7 and stored cryogenically.

Extinguishing agents such as fly ash, quarry dust and other solid-extinguishing agents are compacted in the shape and size of the inner dimensions of the projectile and inserted.

Storage

The fully operational frozen gas matrix projectiles are stored in cryogenic storage facilities and mobile reefer containers that are strategically located. The quantum of projectiles to be stored in ready to use condition is to be arrived at by taking into account the fire occurrence possibility, season, weather conditions, conditions of the fuel complex and other fire index criteria of that location and surrounding areas. The frozen matrix payload can also be stored in liquefied form itself in tanks and the projectiles can be filled just prior to transportation. This method results in a more economic way of storing, as the filling and solidification of the projectiles can be done within a very short time span. Storage locations adjoining civilian airfields, helipads, military airfields would serve better by way of aiding rapid mobilization of projectiles. These storage centers are integrated with the network of fire detection and early warning systems.

Once a fire break out is detected these centers are activated for rapid response by way of moving the projectiles over land and air. The insulation 7 (FIG. 3) of the projectiles ensures negligible loss of heat in the transit process to the site of deployment. Reefer containers or high quality insulated containers can be used for moving the stacks of projectiles.

The Method

The Deployment Methods

The projectiles are launched and their payloads pulverized in numerous combinations according to the different methods elucidated as follows at the fire sites.

(1) TERRAIN LAUNCHING SYSTEMS AND PULVERIZATION TIMING MODES.

(2) AERIAL LAUNCHING SYSTEMS AND PULVERIZATION TIMING MODES.

1. TERRAIN LAUNCHING SYSTEMS AND PULVERIZATION TIMING MODES.

Launching Systems Using Modified Artillery Guns, Multibarrel Rocket Launchers

On receiving a fire alert the projectiles 1 (FIG. 1) are transported by air and land. On reaching the site of the fire, the explosive charges 13 are inserted into the slots under the metal cladding 9 and the control systems 16 inside are armed, by opening the anterior hemispherical cover 2 of the projectile 1. FIG. 1 and FIG. 4. The projectiles 1 (FIG. 1) are then attached with the cartridge case 26 (FIG. 4) and primer for the explosive charges 13.

As diagrammed in FIG. 7, the projectiles 1 (FIG. 1) are then loaded on to the launchers for the terrain launch mode. The launcher is a modified 23 multibarrel rocket launcher or modified field guns or an improvised standard artillery gun the type of which is determined according to the exigencies and anticipated deployment modes and terrain contours. The barrels 19 of the launchers 23 are slotted 18 to accommodate the fins 4 (FIG. 1) of the projectiles. The launcher barrel support assembly 25 positions the barrels at the desired angle according to the coordinates received to ensure accurate descent over the target zones. In a forest fire scenario where terrain based launchers could not be moved to the desired proximity due to the uneven contours of the terrain, the velocity of the launch are to be increased to achieve reach by fitting a cartridge case with a more powerful propellant charge in it. On the fire sites, where the launchers could be moved and located in close proximity to the fires, launching can be resorted to, by compressed air assisted and spring assisted launching method also.

On the site of the fire, the fire ground commander makes a quick survey of the location, magnitude, type of burning substrate and nature of the conflagration. Based on the schematic map and topography of the conflagration and an optional infrared map generated from a manned/unmanned flying craft he gives the order of priority of the deployment sequence to be followed. Adhering to the standard procedure and priority protocols he gives the order regarding the sequence of containment and extinguishing to be followed.

The hottest zones are targeted first to prevent a rise in the temperature of the fuel complex in the proximity. By this time the projectiles are armed and loaded on to their launchers attaching the cartridge chamber loader with the propellant charge. The fire crews are then given the coordinates corresponding to that order and feed them on to the control systems. The launchers then fire the projectiles according to the coordinates that correspond to the commander's orders.

The projectiles are sent into trajectory. The angle and velocity of the launch is executed so as to make the descent of the projectile is parallel to the ground on the target location. Upon launching the projectiles in tandem or simultaneously on a curved trajectory as per the approved coordinates, the ground based controls or the airborne controls as the case may be, track the trajectory to make the projectile's payload explode at the optimum height above the fires. Alternatively in FIG. 8, the altimeters housed in the anterior dome of the projectile can be preset to trigger detonation at a specific height. This process leads to the 21 pulverization/sublimation of the inert gases instantaneously over the fire engulfing it with a cloud of gases effectively cutting off the vital oxygen supply to the burning process.

Alternate launching of frozen gas extinguishing agent and compacted solid extinguishing agents enhance complete annihilation of the fires. A frozen agent payload is detonated first FIG. 6 above the burning substrate. This cuts off the oxygen supply and cools the substrate. Next the compacted solid agents dispersed on the burning substrate as a forceful wave tend to cling as a coat onto the burning surface thereby cutting off the oxygen supply, acts as a shield and prevents it from heating up again. This process when repeated sufficiently and alternatively, effectively extinguishes the fires.

Pulverisation Timing Modes for Terrain Launched Projectiles (1) PRESET DETONATING TIMERS (2) MANUALLY CONTROLLED DETONATING TIMERS (3) AUTOMATED LOGIC CONTROLLED DETONATORS 1. Preset Detonating Timers The coordinates for the terrain launching are fed into the launcher systems 23 (FIG. 7) as per the order of the field commander. The projectiles 18 are armed and the altimeter? connected to the detonator is set at a predetermined height at which it signals the detonator to explode the charge. Optionally the launcher systems can be networked with real time infrared mapping systems of the conflagration. Optimized coordinates corresponding to the map of the conflagration are changed with every launch and based on the extinguishing effected by the preceding pulverizations. This enables a rapid and more accurate response from the launching systems.

2. Manually Controlled Detonating Timers

The coordinates for the terrain launching are fed into the launcher systems 23 as per the order of the field commander. The projectiles are armed and loaded on to the launching systems. The detonators are triggered by a remote signal from the fire crew positioned at points with a strategic view. With every launch ordered from this point the detonation height is manually controlled by remote triggering at the desired optimal height FIG. 7. This method is adopted wherever the topography of the conflagration is visible from a safe distance. This manual method of controlling the height of pulverization gives an edge over preset timer method in that the detonation height can be made to vary continually according to the height of the flames, the nature of the burning substrate and the rapidly changing intensity of the fires. This method can also be deployed in addition with other modes as mop up operation to prevent reignition of extinguished areas.

3. Automated Logic Controlled Detonators

The establishment of three networked subsystems executes this method of pulverization timing mode.

(1) Launchers (2) Ground based or air based real-time infrared mapping system (3) Fuzzy logic enable automated trigger system In this mode of arriving at pulverization timing which can achieve a very high degree of accuracy in optimal height pulverization, the launchers are networked with a ground based/air based real time infrared mapping system along with a fuzzy logic controller which can either be land based or air based. The priority and the respective coordinates are fed into a logic control system. This system is networked with the positioning and firing system of the terrain launchers 23 (FIG. 7). The fuzzy logic controller is a unit designed to process all the relevant inputs from various sources like the infra red mapping system, wind speed, wind direction, rate of spread of fire, temperature at various points of the conflagration, type of burning substrate, contour of the terrain, and all other relevant factors. Real time data sent from the flying craft's infrared mapping system is processed continuously by the logic control system optimizing the sequence, location, type of extinguisher payload, combinations of the extinguisher payload, frequency of the launch, the most effective altitude of detonation and optimum targets are continuously determined and this order is executed by the terrain based launchers automatically. Refer flow chart FIG. 9.

The fuzzy logic controllers continuously send the commands to the terrain launchers on:

(1) Launch timing (2) Launch coordinates (3) Activates detonation of the charge at optimal heights The infrared mapping system feeds the fuzzy logic controller on the effect of the annihilation of the fires by the projectiles already launched. This enables the fuzzy controller to constantly optimize further launches and their timings.

2. Aerial Launching Systems and Pulverization

Launching/Dropping Systems Using Modified Aircrafts, Helicopters, Unmanned Fixed Wing Flying Crafts On receiving a fire alert the projectiles are transported by air and land to the air craft launching pads/airports/exclusive airstrips. On reaching the site of the launch referring to FIG. 1 AND FIG. 5, the explosive charges 13 are inserted into the slots under the metal cladding 9 & 10 and the control systems 16 inside are armed, by opening the anterior hemispherical cover 2 of the projectile 1. The projectiles are then loaded on to the launchers stacks for the aerial launch mode. Aerial dropping is resorted to in situations where the required reach and proximity to the fires is not achievable through the terrain launchers. Large-scale conflagrations in multiple locations also call for aerial launch mode as an effective method.

For the air launch mode FIG. 8, the projectiles are arranged in stacks inside the aircraft 20 to enable accurate and rapid release over the target zones. Referring to FIG. 3, these projectiles are equipped with aerodynamic fins 4 and their weight is balanced in such a way to ensure horizontal descent with the metal cladding 9 and high tensile steel angle 10 always on the top. The projectiles are released according to the coordinates furnished by the fire ground commander or independently arrived according to protocols with inputs from the dropping air craft's onboard sensing and control systems itself. In air dropping modes the projectiles are dropped over the fires. The projectiles descend over the fires at an angle parallel to the ground and on reaching the determined height the payload is pulverized over the fires FIG. 8. by various methods using the sensors/receivers located on the projectile.

On the site of the fire, the fire ground commander makes a quick survey of the location, magnitude, type of burning substrate and nature of the conflagration. Based on the schematic map and topography of the conflagration and an optional infrared map generated from a manned/unmanned flying craft he gives the order of priority of the deployment sequence to be followed. Adhering to the standard procedure and priority protocols he gives the order regarding the sequence of containment and extinguishing to be followed. The hottest zones are targeted first to prevent a rise in the temperature of the fuel complex in the proximity. By this time the projectiles are armed and loaded on to their launchers. The fire crews are then given the coordinates corresponding to that order and feed them on to the control systems. The launchers then drop the projectiles according to the coordinates that correspond to the commander's orders.

The projectiles are sent into trajectory. The angle and release is executed so as to make the descent of the projectile parallel to the ground on the target location. Upon launching/dropping the projectiles in tandem or simultaneously as per the approved coordinates, the ground based controls or the airborne controls as the case may be, track the trajectory to make the projectile's payload explode at the optimum height above the fires. Alternatively the altimeters housed in the anterior dome 2 (FIG. 1) of the projectile can be preset to trigger detonation at a specific height. This process leads to the pulverization/sublimation of the inert gases instantaneously over the fire engulfing it with a cloud of gases effectively cutting off the vital oxygen supply to the burning process.

The frontier zones where the spread rate is rapid are targeted first towards effective containment Alternate launching of frozen gas extinguishing agent and compacted solid extinguishing agents enhance complete annihilation of the fires. Multiple runs of an aircraft and drop over the fires or multiple flying crafts in formation dropping projectiles effectively cover, contain and extinguish the fires. A frozen agent payload is detonated first above the burning substrate. This cuts off the oxygen supply and cools the substrate. Next diagrammed in FIG. 6, the compacted solid agents 11 dispersed on the burning substrate as a forceful wave tend to cling as a coat onto the burning surface thereby cutting off the oxygen supply, acts as a shield and prevents it from heating up again. This process when repeated sufficiently and alternatively, effectively extinguishes the fires.

Pulverisation Timing Method for Aerially Launched/Air Dropped Projectiles (1) PRESET DETONATING TIMERS (2) MANUALLY CONTROLLED DETONATING TIMERS (3) AUTOMATED LOGIC CONTROLLED DETONATORS 1. Preset Detonating Timers The aircrafts loaded with the projectiles make a dive to the lowest possible altitude above the fires. The projectiles are released in tandem over the fires and glide on a trajectory parallel to the ground. The projectiles on descending to a preset height which is, determined taking all the variables into consideration, the payload is pulverized. The detonation height is preset before release. In this method irrespective of the concentration and height of the fires the projectiles will be pulverizing their payload at preset heights.

2. Manually Controlled Detonating Timers

The aircrafts loaded with the projectiles make a dive to the lowest possible altitude above the fires. The projectiles are released in tandem over the fires and glide on a trajectory parallel to the ground. A remote triggering controller located either in the aircraft or on the ground positioned at a vantage point is triggered manually by an operator. This method will work on the basis of visual feedback and is adjusted constantly according to the orders of the field commander.

3. Automated Logic Controlled Detonators

The establishment of three networked subsystems executes this method of pulverization timing mode.

(1) Ariel Launchers/Air dropping mechanisms (2) Ground based or air based real-time infrared mapping system (3) Fuzzy logic enabled automated trigger system In FIG. 8, the aircrafts 20 loaded with the projectiles make a dive to the west possible altitude above the fires. The projectiles are released in tandem over the fires and glide on a trajectory parallel to the ground. The projectiles are released according to the coordinates furnished by the fire ground commander or independently arrived according to protocols with inputs from the dropping air craft's onboard sensing and control systems itself.

At the core of the automated projectile dropping and controlled/continuously variable pulverization altitude of the extinguishing agents lies a fuzzy logic controller. This fuzzy logic control unit is programmed to collect, collate, and analyze real time data on crucial variables like wind direction, intensity of fires, rate of spread, type of fuel complex, height of the flames, type of the explosive charge, infrared map, air speed of the dropping craft etc. This unit then arrives at the best possible release locations for the projectiles from the air, intensity of release, optimum pulverization height, direction, combination of payloads etc. This process is continuous and changes are made by this fuzzy logic unit in the deployment modes according to the evolving situations on the ground. Refer to the flow chart FIG. 10.

The real time data required by this logic unit is provided by onboard sensors of the flying craft that are assigned to release the projectiles, or an independent unmanned or manned craft equipped with the required sensors and trackers relay the data.

The fuzzy logic controllers continuously send the commands to the aerial launchers/air dropping mechanisms on:

(1) Launch/air dropping timings (2) Launch/air dropping coordinates (3) Activates detonation of the charge at optimal heights.

The infrared mapping system feeds the fuzzy logic controller on the effect of the annihilation of the fires by the projectiles already launched. This enables the fuzzy logic controller to constantly optimize further launches and their timings.

The projectiles are programmed to be in continuous touch with this logic unit. The projectiles are dropped from the flying crafts as per the inputs received from the logic unit. The descent of the projectiles are tracked by the sensor units and relayed to the logic unit. On reaching optimum altitudes over the fires, the logic unit transmits the signal to the projectiles onboard receiving unit to pulverize the extinguishing agents over the fires.

The real time feed back of the effect of pulverization is in turn collected from the sensor units, collated and analyzed on a continuous basis and the next wave of projectiles are given a command to pulverize at an different altitude and location in accordance to the evolving situation. Computer aided tracking systems of the projectile's trajectory enables accurate delivery and detonation at the desired altitudes over the fires. The coordinates are constantly adjusted with each launch with real time feed back. Depending on the intensity, substrate, wind direction, height of the flames, rate of spread the bombardment density is decided. The number of detonations for a given area is then optimized for effective containment and extermination of fires. A periodic and quick appraisal of the ongoing process will enable the fire ground commander to arrive at and call for additional backups of projectiles from nearby storage centers if deemed necessary.

Elucidation of the General Operational Sequence of the Terrain Launch Mode and Deployment Cycle with Reference to the Block Diagram in FIG. 9.

This block diagram explains the operational sequence of the deployment cycle of the terrain launched projectiles. The flow chart reveals the method by which the process is started with the detection of fire. Upon this the manned/unmanned airborne mapping/tracking units take to air. The real time data generated by the units are continuously sent to the fuzzy logic control unit. This control unit processes the data and sends the coordinates to the positioning unit of the terrain launchers. The launchers fire the projectiles and are tracked by the air borne units.

The control unit sends the signals to trigger detonation of the explosive charge of the projectile at optimum height and location over the fires. The effect of the pulverization over the fires are mapped by the air borne units and sent to the control unit. Based on the feed back the next launch coordinate, height of pulverization and height of detonation is decided by the control unit. This cycle is repeated until the entire conflagration is effectively annihilated.

Elucidation of the General Operational Sequence of the Aerial Launch Mode and Deployment Cycle with Reference to the Block Diagram in FIG. 10.

This block diagram explains the operational sequence of the deployment cycle of the aerially launched projectiles. The flow chart reveals the method by which the process is started with the detection of fire. Upon this the manned/unmanned airborne mapping/tracking units take to air. The aerial launch/drop aircrafts loaded with the projectiles also take to air. The real time data generated by the mapping and tracking units are continuously sent to the ground based or airborne fuzzy logic control unit 1. This control unit processes the data and sends the coordinates and the precise drop zones to the airborne units. The launchers unload the projectiles and are tracked by the air borne units. The control unit sends the signals to trigger detonation of the explosive charge of the projectile at optimum height and location over the fires after it has descended to the desired location. The effect of the pulverization over the fires are mapped by the air borne units and sent to the control unit. Based on the feed back the next drop coordinate, height of pulverization and height of detonation is arrived by the control unit. This cycle is repeated until the entire conflagration is effectively annihilated.

While the invention has been described in several preferred embodiments, it is to be understood that the words, which have been used, are words of description rather than words of limitation and that changes within the purview of the basis of the above device and method may be made without departing from the scope and spirit of the invention in its broader aspect.

Although the present invention has been described herein before and illustrated in the accompanying drawings, with reference to a particular embodiment thereof but it is to be understood that the present invention is not limited thereto but covers all embodiments of the improved fire extinguishing apparatus which would fall within the ambit and scope of the present invention as would be apparent to a man in the art.

The foregoing description of the preferred embodiment has been presented for purposes of illustration and description. It is not intended to be exhaustive nor to limit the invention to the precise form disclosed, and many modifications and variations are possible in light of the above teaching. The embodiments were chosen and described to best explain the principles of the invention and its practical application.

While the foregoing description makes reference to particular illustrative embodiments, these examples should not be construed as limitations. Not only can the inventive device system be modified for using it as a delivery vehicle for other materials, frozen or otherwise; it can also be modified for launching from varying type of launchers. Thus, the present invention is not limited to the disclosed embodiments, but is to be accorded the widest scope consistent with the claims below.

What is claimed is:

1. A fire fighting device in the form and mode of a projectile meant to fight fires in forests, terrain and urban structures comprising: an elongated, cylindrical shaped projectile having a front end and a rear end with a metallic frame, the metallic frame having a disc buffer at the rear end and a hinged hemispherical cover at the front end, the hinged hemispherical cover housing wireless receivers, altitude sensors, infrared sensors and detonation activation trigger relays and systems, ribs extending from the rear end to the front end of the cylindrical shaped projectile from a metal cladding and connected to a basal support bar, a tubular shaped explosive charge positioned under the metal cladding, the cylindrical shaped projectile having a containment area containing a frozen mixture of inert gases and an insulating sheath, the cylindrical shaped projectile containing two lower lateral hinged curved metallic doors that open upon detonation, and the projectile having a shape that ensures the ascent and descent of the projectile upon launching and is in a horizontal position with the metal cladding position upwards when in flight.

2. The fire fighting device of claim 1 where the ribs extend in pairs from the rear end to the front end of the projectile.

3. The fire fighting device of claim 1 where the tubular shaped explosive charge is positioned under a metallic angle fixed under the metal cladding.

4. The fire fighting device of claim 1 where the frozen mixture of inert gases is insulated by a sheath of thermo coal encapsulating the projectile.

5. The fire fighting device of claim 1 where the metal cladding is positioned above the explosive charge to direct flow of pulverized extinguishing agents over fires upon detonation.

6. The projectile of claim 1 where the projectile disperses the pulverized extinguishing agents on target and under pressure at a specific height over the fires as determined by a ground based or air borne fuzzy logic control system.

7. The fire fighting device of claim 1 where the explosive charge upon detonation pulverizes said agents to form a downward propagated, pressurized cloud that engulfs a fire.

8. The fire fighting device of claim 1 where the tubular shaped explosive charge extends from the back end of the projectile to the front end of the projectile under the metal cladding that directs the flow of pulverized agents.

9. The device of claim 1 where the containment area is reinforced with the ribs extending from lateral rods to a base rod.

10. The device of claim 1 where the rear end is sealed with a solid steel buffer of sufficient width to withstand a launch.

11. The device of claim 1 where the two lower lateral hinged curved metallic doors hold the agents in the projectile and open outwardly on detonation allowing the agents to be released from the projectile.

12. The device according to claim 1 where the front end is sealed with an anterior flange upon which is where the hinged hemispherical cover is fixed.

13. The device of claim 1 where the wireless receivers, the altitude sensors, the infrared sensors and the detonation activation trigger relays and systems enable the projectile to be detonated at an appropriate height over fires.

14. The device according to claim 1 where the project has a longitudinally balanced weight.

15. The device according to claim 1 where the fins are fixed to the rear end, the front end and sides of the projectile.

16. The device according to claim 1 where projectile is enclosed by an insulating material that disintegrated on detonation.

17. The device according to claim 1 where rear end is fitted with a detachable cartridge case with a primer behind the buffer plate that holds a propellant charge that propels the projectile in its trajectory upon firing.

18. The device of claim 1 where a detonation location is controlled by a fuzzy logic control system a detonation location, detonation height, detonation angle, detonation timing is controlled by the ground based or air borne fuzzy logic control system.

19. The device of claim 1 where the projectile is launched by terrain based launcher systems.

20. The device of claim 1 where the projectile is launched by airborne flying systems.

* * * * *